US005588622A

United States Patent [19]

Gordon, Sr.

[11] Patent Number: 5,588,622

[45] Date of Patent: Dec. 31, 1996

[54] BAG HOLDER

[76] Inventor: M. Brian Gordon, Sr., 403 N. Main St., P.O. Box 392, Columbiana, Ala. 35051-0392

[21] Appl. No.: 373,393

[22] Filed: Jan. 17, 1995

[51] Int. Cl.[6] ..... B65B 67/04

[52] U.S. Cl. ..... 248/101; 248/99; 24/30.5 R

[58] Field of Search ..... 248/101, 95, 99; 294/1.1; 24/30.5 R, 30.5 P, 543

[56] References Cited

U.S. PATENT DOCUMENTS

| | | | |
|---|---|---|---|
| 1,188,955 | 6/1916 | Leonard | 248/101 |
| 1,439,878 | 12/1922 | Erhardt et al. | 248/101 |
| 2,462,973 | 3/1949 | Kelrick | 248/101 |
| 3,861,630 | 1/1975 | Ady | 248/101 |
| 3,893,649 | 7/1975 | Cornell et al. | 248/101 |
| 4,238,868 | 12/1980 | Sternberg | 248/101 |
| 4,312,489 | 1/1982 | Paetzold | 248/97 |
| 4,947,523 | 8/1990 | Robbins, III et al. | 24/30.5 R |
| 5,082,219 | 1/1992 | Blair | 248/99 |

FOREIGN PATENT DOCUMENTS

| | | | |
|---|---|---|---|
| 958658 | 5/1964 | United Kingdom | 248/101 |

*Primary Examiner*—Alvin C. Chin-Shue
*Assistant Examiner*—Anita M. King
*Attorney, Agent, or Firm*—Birch, Stewart, Kolasch & Birch, LLP

[57] ABSTRACT

A bag holder having an inner ring and an outer ring formed as a one-piece member. The bag holder is provided with a hinge point between the inner ring and outer ring for allowing the outer ring to pivot around the inner ring. A locking member is provided for securing the outer ring in place around the inner ring to secure a bag between the inner ring and the outer ring. A release lever is provided for the locking member.

17 Claims, 2 Drawing Sheets

BAG HOLDER

BACKGROUND OF THE INVENTION

1. Field of the Invention

The present invention is directed to a bag holder, and in particular to a bag holder which is formed of a unitary piece of plastic and which is simple to use.

2. Description of the Background Art

Bag holders are in common use in the workplace, in the home and in the yard. The conventional bag holder devices include a rim around which a bag is supported and a handle which is connected to the rim for a person to hold on to the bag holder. However, the conventional bag holder devices suffer from the disadvantage that the assembly of the bag on the holder can be complicated or awkward.

SUMMARY AND OBJECTS OF THE INVENTION

It is an object of the present invention to provide a bag holder with a simple construction for holding open the opening of a bag.

Another object of the present invention is to provide a bag holder with a means of securing the bag to the bag holder which is simple in construction and in use.

A further object of the present invention is to provide a bag holder device which is safe to use.

A still further object of the invention is to provide a bag holder which is inexpensive to manufacture, durable in use, and refined in appearance.

These and other objects of the present invention are accomplished by means of a bag holder device, comprising: a handle portion; an inner ring connected to said handle portion; and an outer ring attached to said inner ring at a hinge point; wherein said handle portion, said inner ring and said outer ring are formed as one piece.

These and other objects of the present invention are further accomplished by a bag holder device, comprising: a handle portion; an inner ring connected to said handle portion; an outer ring attached to said inner ring; a base locking member disposed on said handle portion; and an outer ring locking member disposed on an end of said outer ring, wherein said base locking member and said outer ring locking member engage with each other to firmly secure said outer ring around a circumference of said inner ring.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
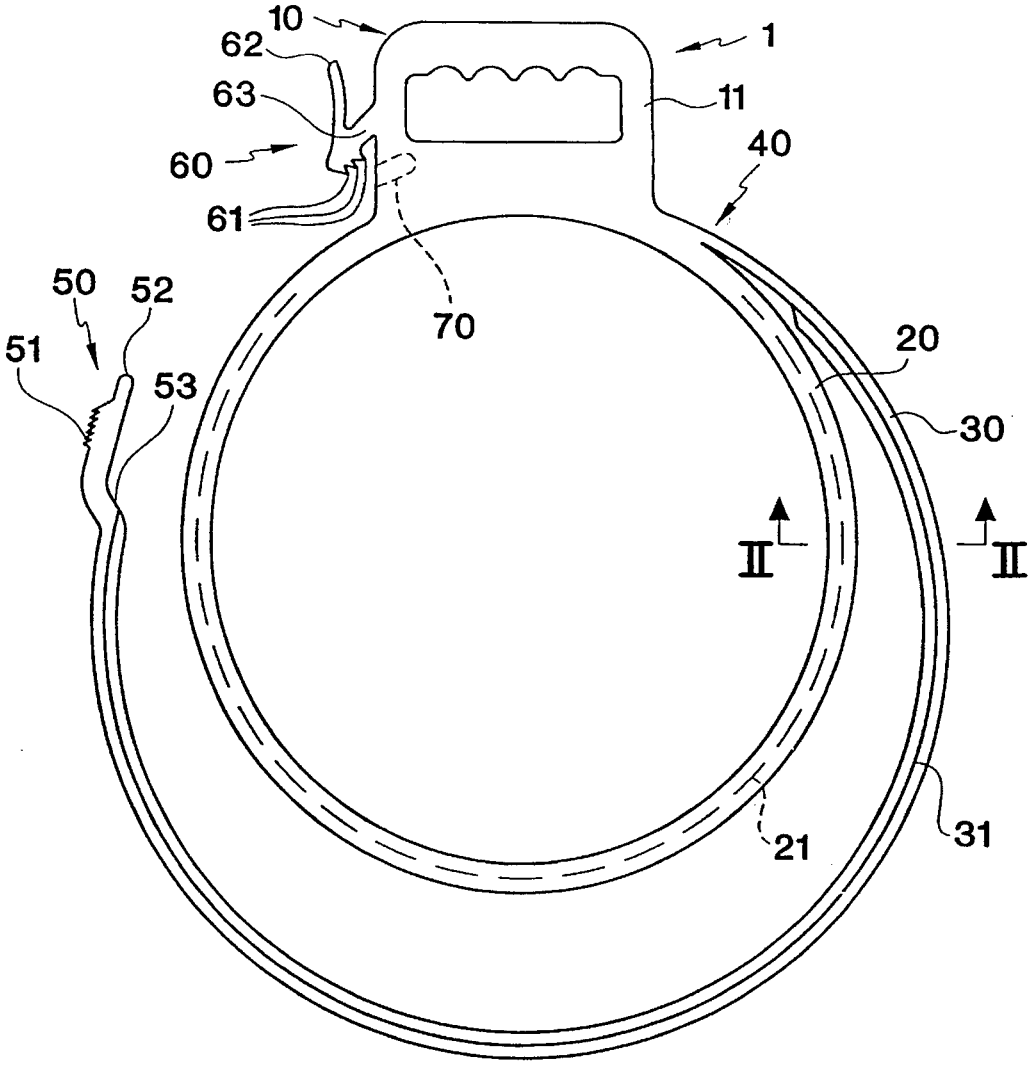
FIG. 1 is a plan view of a bag holder according to the principles of the present invention.
Figure 2:
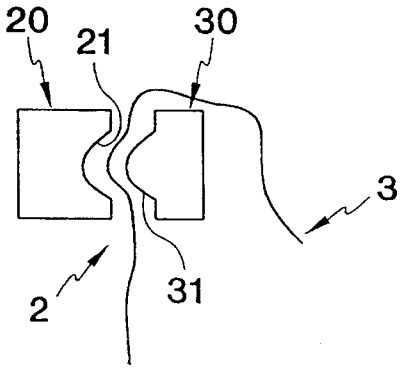
FIG. 2 is a section view along the line II—II of FIG. 1 which illustrates how a bag would be maintained between an inner ring and outer ring of the bag holder.

Referring now in detail to the drawings for the purpose of illustrating preferred embodiments of the present invention, the bag holder device as shown in FIGS. 1 and 2 includes a handle portion 10, a closed inner ring 20 and an open outer ring 30 all formed from one piece of plastic.

The inner ring 20 is substantially circular in shape and is rigidly connected to the handle portion 10. The outer ring 30 is attached at one end to the inner ring 20 at a location adjacent to the handle portion 10. The attachment between the outer ring and the inner ring is obtained through a hinge portion 40 which is flexible and allows the outer ring to pivot relative to the inner ring. The hinge portion 40 has a thin construction relative to the inner ring 20 and the outer ring 30.

The outer ring 30 is provided with a protruding portion 31 which is received in a receiving portion 21 of the inner ring 20. A bag 2 is retained between the inner ring 20 and outer ring 30, as shown in FIG. 2. The bag 2 would be tightly received between the receiving portion 21 and the protruding portion 31 of the inner and outer rings 20,30, respectively.

It is anticipated that the protruding portion 31 and the receiving portion 21 of the outer ring 30 and the inner ring 20, respectively, could each be provided with teeth, bumps or other types of protrusions in order to securely maintain the plastic bag between the inner ring 20 and the outer ring 30.

The outer ring 30 is provided with a bent neck portion 53 which supports an outer ring locking member 50 at the free end of the outer ring 30. The outer ring locking member 50 includes a plurality of locking teeth 51 and a safety extension 52. The outer ring locking member 50 engages a base locking member 60. The base locking member 60 includes a plurality of locking teeth 61 which adjustably engage the plurality of locking teeth 51 of the outer ring locking member 50. A safety detent 70 in the form of a cavity or hole is provided in a base portion 11 for receiving the safety extension 52 of the outer ring locking member.

The base locking member 60 is also provided with a release lever 62 and a hinge portion 63, the latter converting the base locking member 60 to one side of the handle portion 10. The hinge portion 63 is formed in the wall of the base portion 11 above the detent 70. In use, the release lever 62 can be pulled back causing the base locking member 60 to pivot about the hinge portion 63. At this time, the plurality of locking teeth 61 of the base locking member 60 disengage the plurality of locking teeth 51 of the outer ring locking member 50. The safety extension 52, is inserted in safety detent 70. The inner walls of this safety detent 70 engage the safety extension 52 which, prevents the outer ring 30 from moving outward along with the base locking member 60 when the release lever 62 is pulled, and also prevents the outer ring 30 from springing outward and striking a user of the bag holder device 1.

Figure 3:
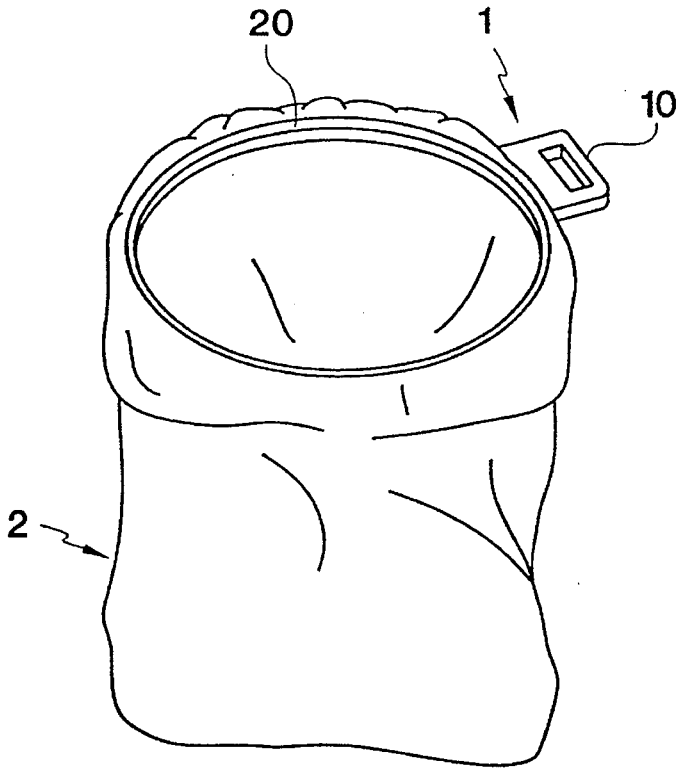
FIG. 3 is a perspective view illustrating the use of the bag holder according to the present invention in holding a plastic bag.

FIG. 3 illustrates the use of the bag holder device 1 for holding a plastic bag 2.

Figure 4:
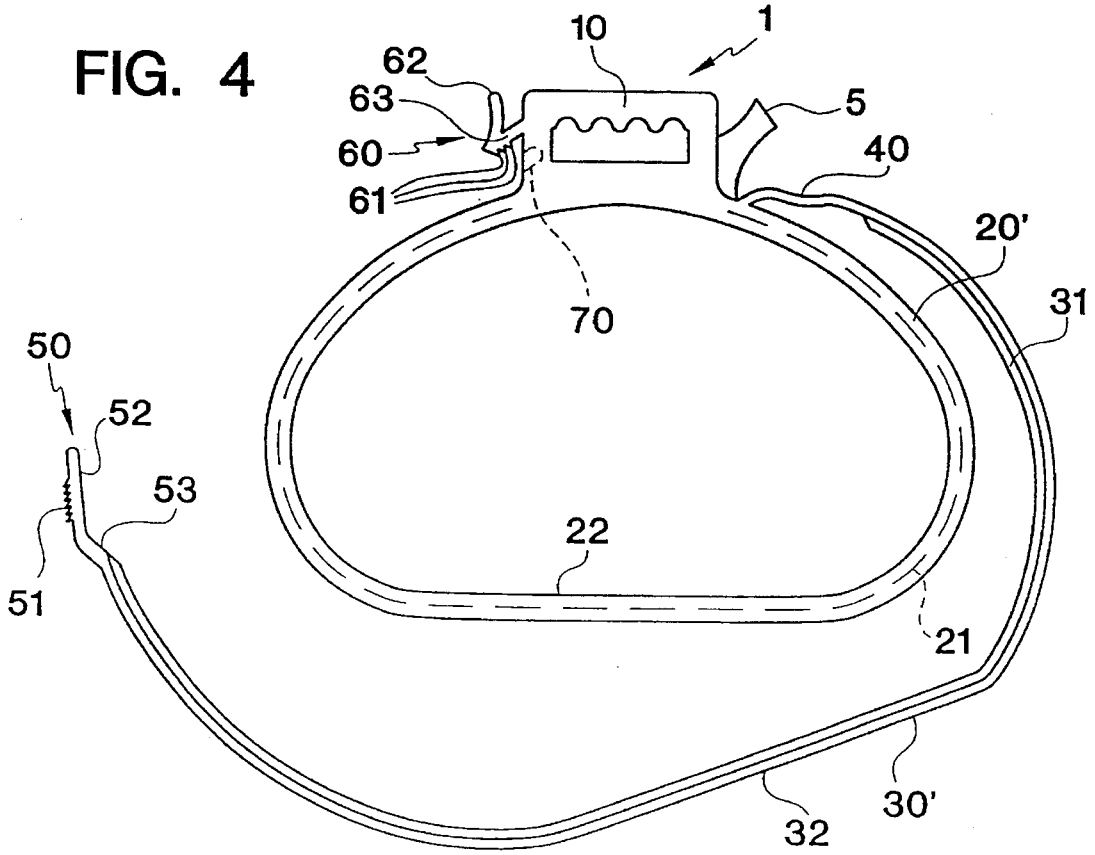
FIG. 4 illustrates another embodiment of the present invention wherein the inner and outer rings have a D-shape.

Referring now to FIG. 4, another embodiment of the present invention is disclosed wherein like reference numerals refer to the same elements as in the embodiment of FIG. 1. In the embodiment of FIG. 4, the inner and outer rings 20' and 30' are each formed substantially in a D-shape. The flat faces 22,32 of the inner and outer ring 20', 30', respectively, each facilitate the use of the bag holder device 1 for placement on the ground or against other flat surfaces.

The embodiment of FIG. 4 also illustrates the use of a broom-handle type socket 5 which would be of a standard size for receiving a threaded handle. The socket 5 could also be used on the embodiment of FIGS. 1–3, although it is not presently shown. In FIG. 4, the socket 5 is disposed on a side of the handle 10. The use of the bag holder device 1 with an elongated handle inserted in the socket 5 provides for simplified use of the bag holder device with a rake or a broom for picking up debris.

The plurality of locking teeth 51 and 61 provided on the outer ring locking member 50 and base locking member 60 serve to provide a life extending feature for the bag holder device 1. In particular, by providing a plurality of locking teeth on each of the outer ring locking member 50 and the base locking member 60, the bag holder device compensates for stretch that may occur in the outer ring 30 during the use of the bag holder device. Therefore, as the outer ring 30 is stretched during the periods of use of the bag holder device 1, the safety extension 52 can be inserted further into the safety hole 70 of the base portion 11 and the plurality of locking teeth 51 and 61 can be utilized in order to further tighten the outer ring 30 around the circumference of the inner ring 20, thereby extending the usable life of the bag holder device.

The bag holder device, according to the present invention, is easy to use because of its one-piece construction. The one-piece construction makes it convenient for mounting a plastic bag on the bag holder device since the entire bag holder device 1 can be easily handled with one hand while the bag to be held by the bag holder device can be handled with the other hand. Prior art devices which include multiple pieces cannot be handled as easily as the one-piece bag holder device of the present invention. In addition, the outer ring locking member 50 and base locking member 60 provide a simple structure for locking the plastic bag in place. The release lever 62 also provides a simple means of releasing the plastic bag.

As mentioned above, FIG. 2 illustrates how a plastic bag would be mounted onto the bag holder device 1. In FIG. 2, the plastic bag 2 is inserted between the inner ring 20 and outer ring 30 and the outer edge of the plastic bag 2 is shown to be lapped over the outer ring 30. However, it is also anticipated that the outer edge of the plastic bag 2 could be inserted downward between the inner ring 20 and outer ring 30 after being lapped over from the interior side of the inner ring 20.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A one piece bag holder device, comprising:

a closed inner ring having a handle portion attached to a periphery thereof;

an open outer ring attached to said closed inner ring at a hinge portion which is adjacent to said handle portion on a first side of said handle portion;

locking means for engaging a second end of said open outer ring on a second side of said handle portion opposite said first side; and a socket portion for receiving a handle;

wherein said open outer ring is adapted to be wrapped around a periphery of said closed inner ring in order to secure a bag therebetween and is locked in place by said locking means;

wherein said bag holder device is made of one piece of plastic; and wherein said locking means includes an outer ring locking member disposed on an end of said open outer ring, and a base locking member, wherein said base locking member and said outer ring locking member engage with each other to firmly secure said open outer ring around the periphery of said closed inner ring.

2. The one-piece bag holder according to claim 1, wherein said base locking member and said outer ring locking member each include a plurality of locking teeth.

3. The one-piece bag holder according to claim 1, wherein said base locking member includes a release lever for releasing said base locking member from engagement with said outer ring locking member.

4. The one-piece bag holder according to claim 1, further comprising:

a base portion which is disposed between said handle portion and said closed inner ring, a safety detent disposed in a side of said base portion; and a safety extension disposed on an end of said outer ring locking member, wherein said safety extension is received by said safety detent to prevent the open outer ring from springing outward when said base locking member and said outer ring locking member are disengaged.

5. The one-piece bag holder according to claim 1, wherein said one-piece bag holder is substantially D-shaped.

6. The one-piece bag holder according to claim 1, wherein said open outer ring includes a protruding portion which is received by a receiving portion of said closed inner ring.

7. The one-piece bag holder according to claim 1, wherein said hinge portion is a flexible plastic portion which is narrow in width relative to a width of said open outer ring.

8. A bag holder device, comprising:

a handle portion;

a closed inner ring connected to said handle portion;

an open outer ring attached to said closed inner ring;

a base locking member disposed on said handle portion;

an outer ring locking member disposed on an end of said open outer ring, wherein said base locking member and said outer ring locking member engage with each other to firmly secure said open outer ring around a circumference of said closed inner ring;

a base portion which is disposed between said handle portion and said closed inner ring;

a safety detent disposed in one side of said base portion; and a safety extension disposed on an end of said outer ring locking member, wherein said safety extension is received in said safety detent to prevent the open outer ring from springing outward when said base locking member and said outer ring locking member are disengaged.

9. The bag holder according to claim 8, wherein said handle portion, said closed inner ring and said open outer ring are formed as a one-piece plastic member.

10. The bag holder according to claim 8, wherein a hinge portion attaches said open outer ring to said closed inner ring and said hinge portion is a flexible plastic portion which is narrow in width relative to a width of said open outer ring.

11. The bag holder according to claim 8, wherein said base locking member and said outer ring locking member each include a plurality of locking teeth.

12. The bag holder according to claim 8, wherein said base locking member includes a release lever for releasing said base locking member from engagement with said outer ring locking member.

13. The bag holder according to claim 8, further comprising a socket portion for receiving a handle.

14. The bag holder according to claim 8, wherein said bag holder device is substantially D-shaped.

15. The bag holder according to claim 8, wherein said open outer ring includes a protruding portion which is received by a receiving portion of said closed inner ring.

16. The bag holder according to claim 8, wherein said handle portion, said closed inner ring, said open outer ring, said base locking member and said outer ring locking member are formed as a one-piece plastic member.

17. A one-piece bag holder device, comprising:

a closed inner ring having a handle portion attached to a periphery thereof;

an outer ring attached to said closed inner ring at a hinge portion which is adjacent to said handle portion on a first side of said handle portion;

locking means for engaging a second end of said outer ring on a second side of said handle portion opposite said first side, said locking means including an outer ring locking member disposed on said second end of said ring, and a base locking member provided on said closed inner ring;

a base portion which is disposed between said handle portion and said closed inner ring;

a safety detent disposed in a side of said base portion; and a safety extension disposed on an end of said outer ring locking member, wherein said safety extension is received by said safety detent to prevent the outer ring from springing outward when said base locking member and said outer ring locking member are disengaged;

wherein said outer ring is adapted to be wrapped around a periphery of said closed inner ring in order to secure a bag therebetween and is locked in place by said locking means.

* * * * *